US012698071B1

(12) United States Patent
Kauffman

(10) Patent No.: US 12,698,071 B1
(45) Date of Patent: Aug. 4, 2026

(54) JET OUTBOARD MOTOR NOZZLE STEERING ASSEMBLY

(71) Applicant: Brent Kauffman, Marysville, PA (US)

(72) Inventor: Brent Kauffman, Marysville, PA (US)

( * ) Notice: Subject to any disclaimer, the term of this patent is extended or adjusted under 35 U.S.C. 154(b) by 282 days.

(21) Appl. No.: 18/656,928

(22) Filed: May 7, 2024

Related U.S. Application Data

(60) Provisional application No. 63/465,639, filed on May 11, 2023.

(51) Int. Cl.
*B63H 20/12* (2006.01)
*B63H 11/113* (2006.01)
*B63H 20/20* (2006.01)

(52) U.S. Cl.
CPC ..... *B63H 20/12* (2013.01); *B63H 11/113* (2013.01); *B63H 20/20* (2013.01)

(58) Field of Classification Search
CPC ..... B63H 20/12; B63H 20/20; B63H 11/11; B63H 11/113
See application file for complete search history.

(56) References Cited

U.S. PATENT DOCUMENTS 3,007,305 A 11/1961 Hamilton
3,082,732 A * 3/1963 Stallman ..... B63H 11/08 60/221
3,192,715 A * 7/1965 Engel ..... B63H 11/113 114/151
3,807,346 A * 4/1974 Delfeld ..... B63H 11/11 440/41
3,842,787 A 10/1974 Giacosa
5,299,960 A * 4/1994 Day ..... B63H 11/107 440/39
5,551,898 A 9/1996 Matsumoto
5,879,209 A 3/1999 Jones
6,893,303 B2 5/2005 Fuse
7,217,165 B2 * 5/2007 Roos ..... B63H 11/11 440/46
7,476,134 B1 1/2009 Fell et al.
10,618,619 B2 4/2020 Basten
11,649,027 B2 5/2023 Basten
(Continued)

OTHER PUBLICATIONS

Christoper Mayville, Marine Jet Drives Operation and Maintenance, http://hdl.handle.net/20.500.12648/12946, Dec. 10, 2019, 20 pages.
(Continued)

*Primary Examiner* — Andrew Polay
(74) *Attorney, Agent, or Firm* — Hooker & Habib, P.C.

(57) ABSTRACT

A steering nozzle assembly for a jet motor of a jet outboard motor includes a mounting frame attachable to the jet motor. The mounting frame is configured to be spaced apart by a gap from the discharge end of a discharge nozzle of the jet motor. The jet motor discharges a water jet that flows through the gap and past the mounting frame into a steering nozzle attached to the mounting frame for relative movement about a steering nozzle pivot axis. A reverse gate is movable from a neutral position away from the water jet to an actuated position in the gap between the discharge nozzle and the mounting frame. When in the actuated position, the reverse gate intercepts and reverses the direction of the water jet to generate reverse thrust before the water jet reaches the steering nozzle.

20 Claims, 8 Drawing Sheets

(56) References Cited

U.S. PATENT DOCUMENTS

| | | | | |
|---|---|---|---|---|
| 2010/0081348 | A1* | 4/2010 | Giroux | B63H 11/113<br>440/42 |
| 2012/0285355 | A1* | 11/2012 | Walkowiak | B63H 11/107<br>114/163 |
| 2023/0286633 | A1* | 9/2023 | Roy-Bernier | B63H 11/113 |

OTHER PUBLICATIONS

Edward West, OutBoard Jets Guide to Installations and Performance, eBook ISBN 978-1-6641-7588-4, 2021, 211 pages.

* cited by examiner

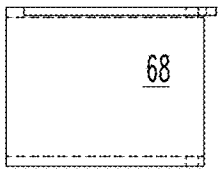
FIG. 10
FIG. 11
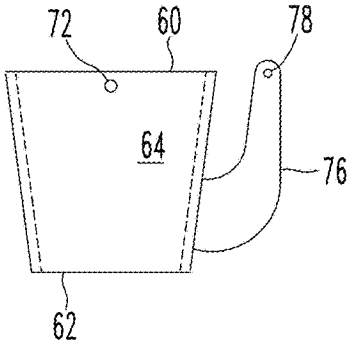
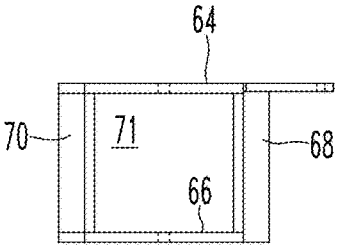
FIG. 9
FIG. 14
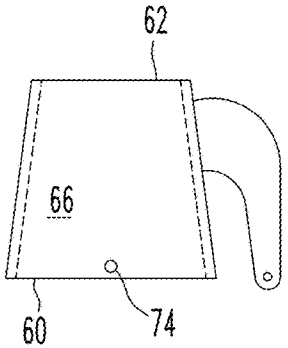
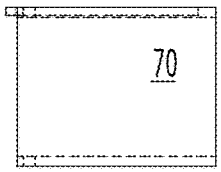
FIG. 12
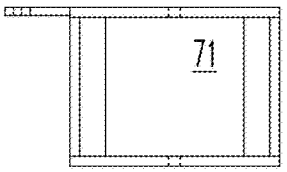
FIG. 13

JET OUTBOARD MOTOR NOZZLE STEERING ASSEMBLY

RELATED APPLICATION

This application is a non-provisional of and claims priority to U.S. provisional patent application Ser. No. 63/465,639 titled "Jet Propelled Watercraft Steering System with Compact Reverse Gate Assembly" filed May 11, 2023, which priority '639 application is incorporated by reference as if fully set forth herein.

FIELD OF THE DISCLOSURE

The disclosure relates generally to a steering system for water jet-propelled watercraft, and in particular, a nozzle steering system for water jet-powered outboard motor boats.

BACKGROUND OF THE DISCLOSURE

Outboard motor boats have and outboard motor attached to the transom of the boat and located adjacent the stern of the boat. Propeller-driven outboard motor boats utilize a propeller driven by the outboard motor to generate propulsive thrust. Jet-powered outboard motor boats utilize a jet motor having a water pump driven by the outboard motor that discharges a water jet to generate propulsive thrust. Additional background information on jet boats and jet outboard motors can be found in *Outboard Jets Guide to Installations and Performance* by Edward West, ISBN 978-1-6641-7590-7, published by Xlibris (xlibris.com), copyright 2021, and in *Marine Jet Drives*, written by Christopher Mayville, copyright 2019 and available for download at http://hdl.handle.net/20.500.12648/12946.

FIGS. 29 and 30 illustrate a jet-powered outboard motor boat 910 having a jet outboard motor 912 that drives a jet motor 914 located at the lower end of the outboard motor. A "jet outboard motor" as used herein is an outboard motor for a boat or other watercraft that drives a jet motor. The outboard motor may possibly be convertible between a jet outboard motor and an outboard motor that drives a propeller.

The jet outboard motor 912 is mounted on the boat's transom 916. A power trim mechanism 918 connected between the boat and the jet outboard motor enables limited angular movement 919 of the jet outboard motor about a horizontal motor trim axis perpendicular with the drawing sheet as viewed in FIG. 30. The power trim mechanism selectively directs the thrust of the jet motor 914 at an upward, downward, or level with respect to the horizontal (perpendicular to the direction of gravity). Trim adjustments raise or lower the bow of the boat by generating thrust having a vertical force component (parallel with gravity) that urges the bow up or down. The jet outboard motor pivots about a horizontal axis (perpendicular to gravity) to change the vertical force component and obtain the desired boat trim.

The jet outboard motor 912 is shown in FIG. 30 set by the power trim mechanism 918 in its most vertical position about the horizontal motor trim axis. The jet motor 914 is positioned in its lowest vertical position and at its closest to the boat transom 916. The power trim mechanism establishes the trim or running angle of the boat while the boat is underway. The power trim mechanism may also lift the jet motor above the boat water line for storage, trailering, maintenance, or the like.

The jet motor 914 has a water intake 920 that receives water into the jet motor. A discharge nozzle 922 discharges the water jet along a longitudinal nozzle discharge axis 923 extending from the discharge nozzle and away from the jet motor to generate thrust. The water intake and the discharge nozzle are both fixed relative to the jet outboard motor.

The illustrated boat 910 includes a tunnel 924 formed on a portion of the bottom of the boat hull. The boat hull tunnel extends longitudinally along the boat center line to a discharge end that extends through the transom 916. The transom is configured to mount the jet outboard motor 912 such that the water intake 920 faces the bout hull tunnel discharge and receives the water discharged from the boat hull tunnel.

The boat hull tunnel 924 enables the entire jet motor 914, including the water intake 920, to be located above the bottom of the boat for very shallow water operation. In boats without a tunnel, the water intake is normally located at a water level below the bottom of the boat.

Left and right steering of the boat 910 is performed by pivoting the entire jet outboard motor to the left or right about an outboard motor steering pivot axis. Steering adjustments generate thrust having a horizontal component (perpendicular with gravity) that urges the boat to turn to the right or left. The jet outboard motor pivots about the steering pivot axis to change the direction of the horizontal force component and obtain the desired steering response.

The jet motor 914 includes a reverse gate 926 pivotally attached to the discharge nozzle 922. The reverse gate moves conjointly with the jet outboard motor 912 about the steering axis during steering. The reverse gate is shown in a neutral position in FIG. 30. In its neutral position the reverse gate does not obstruct the water jet discharged from the discharge nozzle. The reverse gate pivots about a reverse gate pivot axis from the neutral position to move to its actuated position shown in phantom lines in FIG. 30. In its actuated position the reverse gate intercepts and reverses the water jet to apply reverse thrust to the boat.

Boater control of the reverse gate 926 between neutral and actuated positions is typically carried out via an actuator (not shown) attached to the reverse gate. The actuator typically extends to a lever or other operator control in the boat. The neutral and actuated positions of the reverse gate can be defined by the limits of actuator movement or by the reverse gate abutting a member that establishes the desired end position of the reverse gate.

Pivoting the entire jet outboard motor 912 for steering can be avoided by use of a nozzle steering assembly having a movable steering nozzle. An example nozzle steering system is disclosed in Fell, U.S. Pat. No. 7,476,135 (which is incorporated by reference as if fully set forth herein).

FIG. 31 illustrates the Fell nozzle steering assembly 928 attached to the jet nozzle 922 of the boat 910 shown in FIGS. 29 and 30. The Fell nozzle steering assembly includes a conduit 930, a steering nozzle 932, a portion 934 of the steering nozzle carrying a pair of axles 936*a*, 936*b* in communication with the conduit. The steering nozzle is configured to receive a flow of water from the jet nozzle by way of the conduit. The steering nozzle is capable of moving relative to the conduit about a vertical steering nozzle pivot axis 938 defined by the axles. A mechanical actuator 940 is capable of moving the steering nozzle about the steering nozzle pivot axis.

A reverse gate 942 is in communication with the steering nozzle 932. The reverse gate is pivotable about a horizontal gate pivot axis 944. The reverse gate is positionable in a neutral (inactive) stowed position shown in solid lines in FIG. 31 or in an actuated (active) position shown in phantom lines in FIG. 31. In its actuated position the reverse gate intercepts the output from the steering nozzle for reverse thrust. A mechanical reverse gate actuator 946 is capable of selectively positioning the reverse gate in a neutral position or an actuated position.

The conduit 930 completely surrounds the discharge end of the jet motor discharge nozzle 922. The conduit receives into it the entire flow of water issuing from the discharge nozzle. The conduit extends axially along the discharge direction 923 of the jet motor discharge nozzle to a discharge end of the conduit. An annular wall completely surrounds the water flowing through the conduit from the discharge nozzle to the discharge end of the conduit. The water discharged from the conduit flows into the intake end of the steering nozzle 932 and is discharged through the opposite discharge end of the steering nozzle. Pivoting the steering nozzle about the steering nozzle pivot axis 934 changes the direction of flow of water discharged from the steering nozzle relative to the boat for left-right steering.

The reverse gate 942 moves about the reverse gate pivot axis 938 with respect to the steering nozzle 932 to move between its neutral position and its actuated position (shown partially in phantom lines in FIG. 31) for generating reverse thrust.

Left and right boat steering is performed through movement of the steering nozzle 932 about the steering nozzle pivot axis 934. There is no need to pivot the entire jet outboard motor 912 for left and right steering. Accordingly, the jet outboard motor is fixed and held stationary with respect to the boat 910 about the jet outboard motor's former steering pivot axis. Because the jet outboard motor is stationary with respect to the boat for left-right steering, the jet motor 914 is also stationary with respect to the boat for left-right steering.

The reverse gate 926 revolves about the steering nozzle pivot axis 934 with movement of the steering nozzle 932 about the steering nozzle pivot axis. The angle of the reverse thrust generated by the reverse gate with respect to the boat center line is a function of the angular position of the reverse gate with respect to the steering nozzle axis. The direction of the reverse thrust force vector is not parallel with the boat center line if the steering nozzle is not in a straight-ahead position when the reverse gate is in its actuated position generating reverse thrust. The offset of the direction of the reverse thrust vector away from being parallel with the boat center line increases with increasing angular displacement of the steering nozzle away from its straight-ahead position.

Other examples of nozzle-type jet boat steering assemblies that can be adopted for use with jet motors that are fixed and stationary with respect to left-right steering and/or trim adjustment are disclosed in, for example, Matsumoto U.S. Pat. No. 5,551,898, Jones U.S. Pat. No. 5,879,209, Fuse, U.S. Pat. No. 6,893,303, and Basten U.S. Pat. No. 10,618,619. Each of the preceding '898, '209, '303, and '619 patents are incorporated by reference as if fully set forth herein.

It is desirable to provide an improved nozzle steering assembly for an outboard jet motor a jet boat that provides a compact construction and can be more readily adapted for retro-fit attachment to existing jet outboard motors.

SUMMARY OF THE DISCLOSURE

Disclosed is a nozzle steering assembly for a jet outboard motor that provides a compact construction and can be more readily adapted for retro-fit attachment to existing jet outboard motors.

A nozzle steering assembly in accordance with this disclosure includes a mounting frame, at least one mounting arm, a steering nozzle, and a reverse gate.

The at least one mounting arm is connected to the mounting frame. The at least one mounting arm is adapted to fixedly attach the mounting frame to a jet motor of the jet outboard motor.

The at least one mounting arm spaces the mounting frame away from a discharge end of a jet motor discharge nozzle and defines an air gap between the mounting frame and the jet motor discharge nozzle when the mounting frame is attached to the jet motor.

The steering nozzle is pivotally attached to the mounting frame and is movable with respect to the mounting frame about a steering nozzle pivot axis. In operation the steering nozzle is disposed to receive a flow of water discharged from the jet motor discharge nozzle into an intake end of the steering nozzle and to discharge the flow of water through a discharge end of the steering nozzle. Movement of the steering nozzle about the steering nozzle pivot axis with respect to the mounting frame causes a change in the direction of flow of the water discharged from the steering nozzle.

The reverse gate is connected to the mounting frame. The reverse gate is movable with respect to the mounting frame about a reverse gate pivot axis between a neutral position and an actuated position. When the reverse gate is in the neutral position, the reverse gate is disposed to not obstruct the flow of water discharged from the jet motor discharge nozzle when the mounting frame is attached to the jet motor. When the reverse gate is in the actuated position, the reverse gate is disposed in the air gap between the mounting frame and the jet motor discharge nozzle and intercepts and substantially reverses the flow direction of the flow of water discharged from the jet motor discharge nozzle.

In some embodiments of the disclosed nozzle steering assembly, the steering nozzle is attached directly to the mounting frame. The steering nozzle can only move about the steering nozzle pivot axis with respect to the mounting frame. The steering nozzle pivot axis would typically be oriented to extend along a vertical axis with respect to the mounting frame to enable left and right steering of the boat with movement of the steering nozzle. The steering nozzle pivot axis can, alternatively, be oriented to extend along a horizontal axis with respect to the mounting frame to enable trim adjustment, and not left-right steering, of the boat with movement of the steering nozzle about the steering nozzle pivot axis.

The above embodiments of the nozzle steering assembly are intended to provide only left-right steering of the boat or to provide only trim adjustment of the boat. Trim adjustment of jet boats utilizing nozzle steering assemblies in accordance with this disclosure that are for left-right steering only can be provided by the boat having power trim or by manual trim of the jet outboard motor.

In other embodiments of the disclosed nozzle steering assembly, the nozzle steering assembly can provide both left-right steering and trim adjustment of the boat.

In these other embodiments the steering nozzle is attached to the mounting frame by a tilt frame. The tilt frame is pivotally attached directly to the mounting frame and is pivotable about a tilt frame pivot axis with respect to the mounting frame. The steering nozzle is pivotally attached to the tilt frame and is pivotable about a steering nozzle pivot axis perpendicular to the tilt frame pivot axis with respect to the tilt frame.

The tilt frame pivot axis can be oriented to extend along a horizontal axis with respect to the mounting frame whereby displacement of the tilt frame about the tilt frame pivot axis also displaces the steering nozzle about the tilt frame pivot axis for trim adjustment of the boat. The steering nozzle pivot axis can be oriented to extend along a vertical axis with respect to the tilt frame whereby displacement of the steering nozzle about the steering nozzle pivot axis enables left-right steering of the boat.

Alternatively, the tilt frame pivot axis can be oriented to extend along a vertical axis with respect to the mounting frame whereby displacing the tilt frame about the tilt frame pivot axis also displaces the steering nozzle about the tilt frame pivot axis for left-right steering. The steering nozzle pivot axis can be oriented to extend along a horizontal axis with respect to the tilt frame for trim adjustment with displacement of the steering nozzle about the steering nozzle pivot axis.

A steering nozzle when used as a component of a nozzle steering assembly in accordance with this disclosure is used to steer or direct the direction of flow discharged from the steering nozzle for either left-right steering or for trim adjustment of a boat driven by the jet outboard motor.

The disclosed nozzle steering assembly can be used in cooperation with a tunnel formed at least partially in the hull of the boat. The tunnel enables the nozzle steering assembly to be located above the bottom of the boat.

The tunnel has a hull portion formed in the boat hull extending aft from a forward end towards and through the transom of the boat, and an optional external tunnel portion extending from the transom away from the transom. The external tunnel portion includes a pair of side walls that extend from the rear of the boat to the discharge end of the tunnel, assisting in directing the water flowing through the tunnel into the jet motor water intake. An upper opening in the external portion of the tunnel receives the water intake of the jet motor and enables normal use of the power trim to trim the boat and raise/lower the jet motor without interference from the tunnel.

The disclosed nozzle steering assembly has a number of advantages. Because the reverse gate does not move with the steering nozzle and is not in fluid communication with the steering nozzle, the angle of the reverse thrust force vector generated by the reverse gate with respect to the boat center line remains essentially the same for all positions of the steering nozzle. When adapting the nozzle steering assembly for attachment to a conventional jet outboard motor, the reverse gate provided with the jet motor can often be re-used as part of the nozzle steering assembly and can be attached to the same mounting location on the jet motor. And because a pipe is not used to connect the nozzle steering assembly to the jet motor, the nozzle steering assembly can have reduced weight for easier installation.

Other objects and features of the disclosure will become apparent as the description proceeds, especially when taken in conjunction with the accompanying drawings illustrating one or more illustrative embodiments.

BRIEF DESCRIPTION OF THE DRAWINGS

FIGS. 9-14 are rear, right side, top, left side, front, and bottom views respectively of the steering nozzle of the first embodiment nozzle steering assembly.

DETAILED DESCRIPTION

Figure 1:
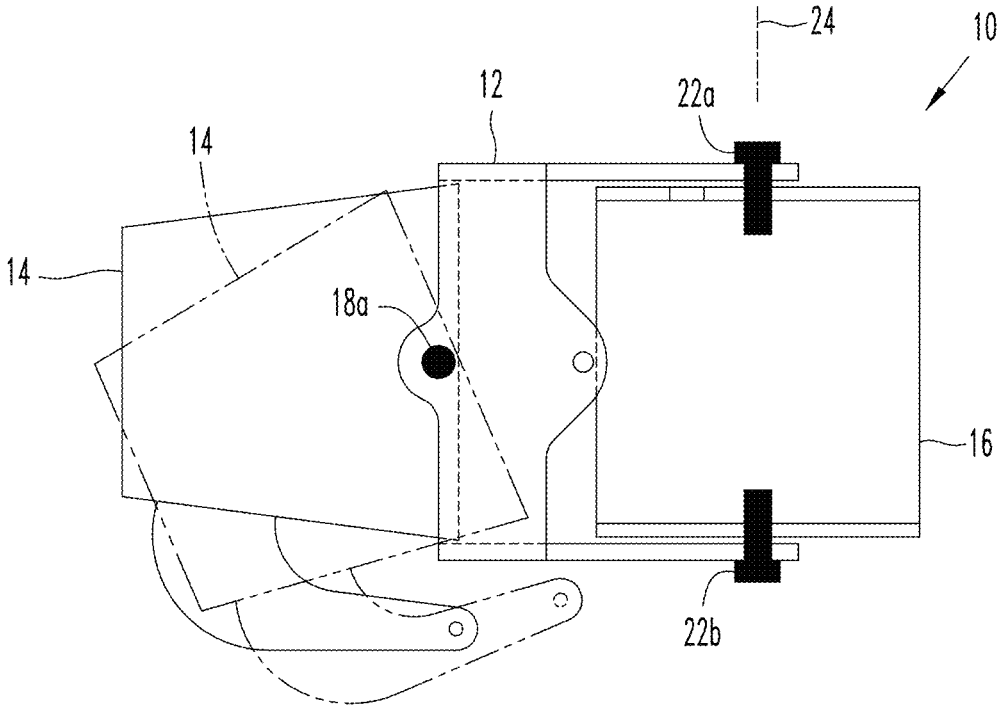
FIG. 1 is a top view of a first embodiment nozzle steering assembly for a jet outboard motor in accordance with this disclosure.
Figure 2:
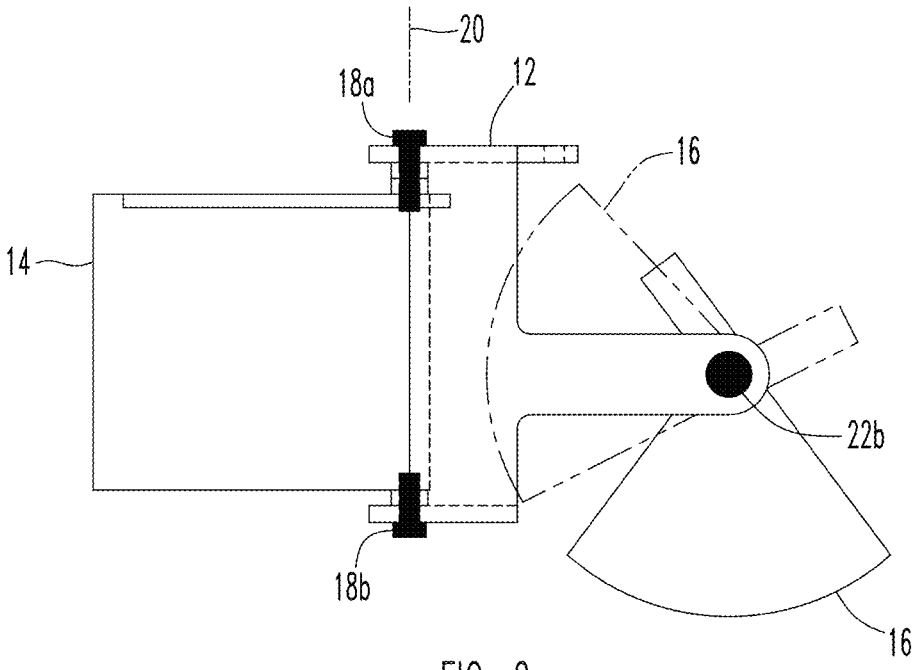
FIG. 2 is a right view of the nozzle steering assembly shown in FIG. 1.
Figure 5:
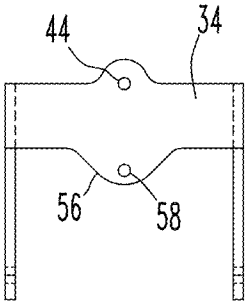
FIGS. 3-8 are front, left side, top, right side, rear, and bottom views respectively of the frame of the first embodiment nozzle steering assembly.
Figure 4:
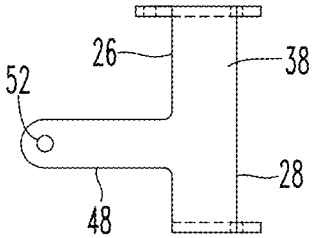
Figure 3:
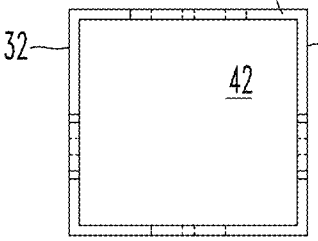
Figure 8:
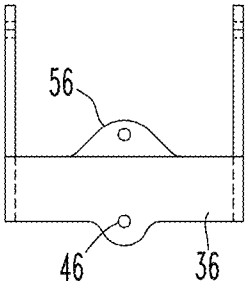
Figure 6:
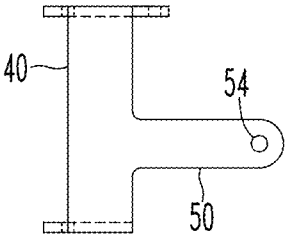
Figure 7:
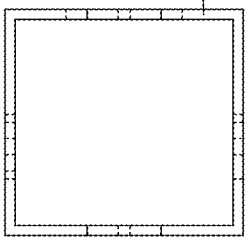
Figure 16:
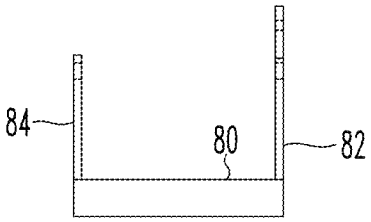
FIGS. 15-20 are right side, front, top, rear, left side, and bottom views respectively of the reverse gate of the first embodiment nozzle steering assembly.
Figure 17:
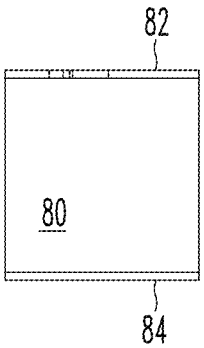
Figure 15:
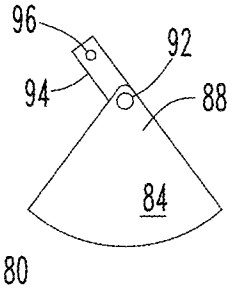
Figure 20:
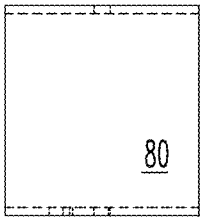
Figure 18:
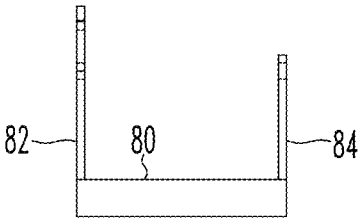
Figure 19:
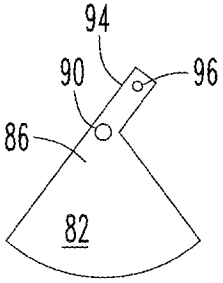

FIGS. 1 and 2 illustrate a first embodiment nozzle steering assembly 10 in accordance with this disclosure. The illustrated nozzle steering assembly 10 is intended for attachment and use with the jet outboard motor 912 shown in FIG. 28. The nozzle steering assembly in use is attached to the jet motor 914 as shown in FIG. 29. Other embodiments of the disclosed nozzle steering assembly can be adapted for attachment and use with other models and configurations of jet motors.

Figure 21:
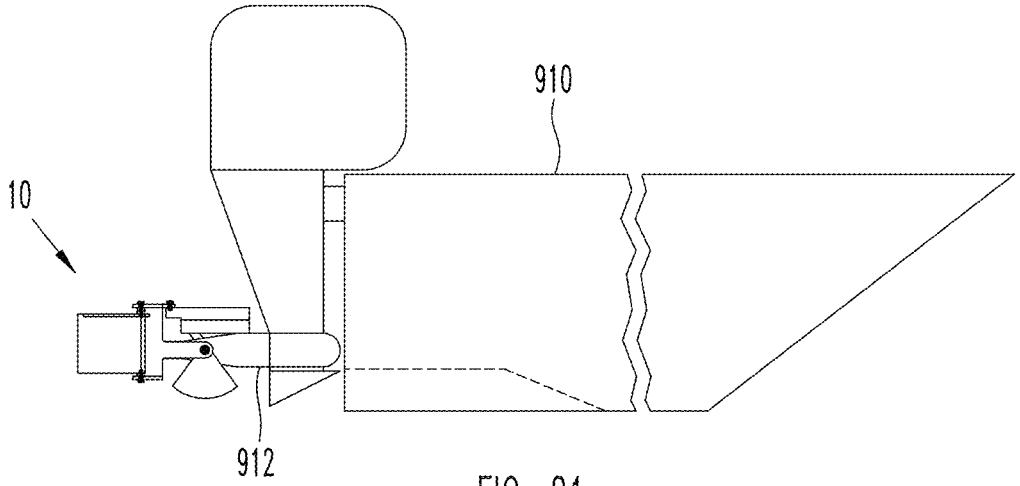
FIG. 21 is a side view of the first embodiment nozzle steering assembly attached to the jet motor of a jet outboard motor boat.
Figure 22:
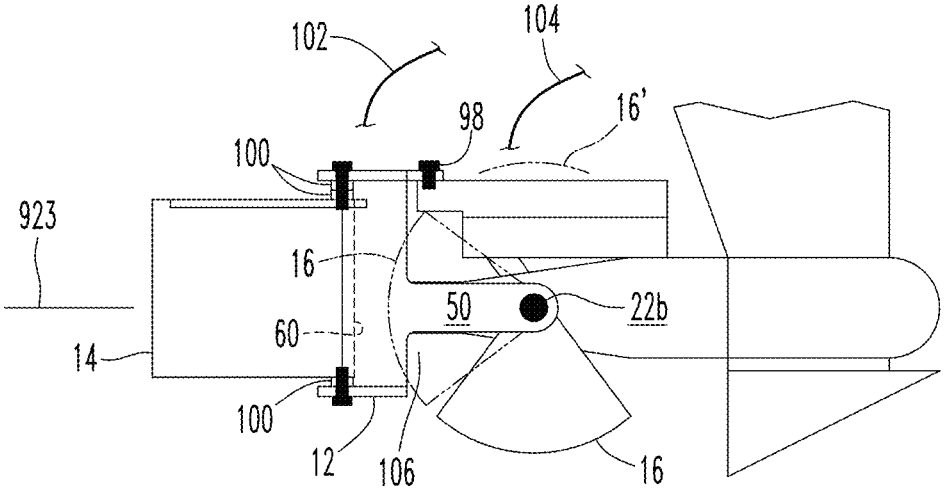
FIG. 22 is an enlarged view of the nozzle steering assembly shown in FIG. 21.

The nozzle steering assembly 10 includes three major components: a mounting frame 12 that fixedly attaches the nozzle steering assembly to the discharge nozzle 920 (see also FIGS. 21 and 22), a steering nozzle 14 pivotally attached to the mounting frame, and a reverse gate 16 pivotally attached to the mounting frame (see also FIGS. 21 and 22).

The steering nozzle 14 is pivotally attached to the mounting frame 12 by a pair of steering nozzle hinge pins 18*a*, 18*b*. The steering nozzle hinge pins define a vertical steering nozzle pivot axis 20. The steering nozzle can pivot left or right with respect to the mounting frame about the steering nozzle pivot axis.

FIGS. 1 and 2 illustrate the steering nozzle 14 in its straight ahead position with respect to the mounting frame 12. FIG. 1 also illustrates with phantom lines the steering nozzle in its right-most steering position with respect to the mounting frame. The steering nozzle does not pivot about a horizontal axis with respect to the mounting frame because the boat's power trim mechanism 918 is responsible for trimming the boat.

The reverse gate 16 is pivotally attached to the mounting frame 12 by a pair of gate hinge pins 22*a*, 22*b*. The gate hinge pins define a horizontal reverse gate pivot axis 24. The gate hinge pins also attach the reverse gate to the discharge nozzle 920 (see FIGS. 21 and 22). The gate hinge pins are also used in fixedly attaching the frame to the discharge nozzle as shown in FIGS. 21 and 22.

FIGS. 1 and 2 illustrate the reverse gate 16 in its stowed, neutral position with respect to the mounting frame 12. FIG. 2 also illustrates with phantom lines the reverse gate in its active, actuated position with respect to the mounting frame.

FIGS. 3-8 illustrate the mounting frame 12. The mounting frame is formed as a generally rectangular member having a front side 26, a rear side 28, a left side 30, and a right side 32. The mounting frame is constructed from a horizontal top wall 34, a horizontal bottom wall 36, a vertical left wall 38, and a vertical right wall 40. The frame walls define a rectangular through-opening 42 extending from the front side to the rear side of the mounting frame and surrounded by the mounting frame walls.

The top wall 34 has a top steering nozzle hinge pin through-hole 44 extending through the thickness of the top wall and centered between the mounting frame side walls 38, 40. The top steering nozzle hinge pin through-hole is located close to the rear side of the mounting frame. The top steering nozzle hinge pin through-hole extends through a widened portion of the top wall. The bottom wall 36 has a bottom steering nozzle hinge pin through-hole 46 like the top pin through-hole. The bottom pin through-hole extends through the thickness of the bottom wall and is centered between the mounting frame side walls. The bottom pin through-hole is located close to the rear side of the mounting frame. The bottom pin through-hole extends through a widened portion of the bottom wall. The top and bottom steering nozzle hinge pin through-holes are coaxial with one another along the steering nozzle pivot axis 20 and respectively receive the nozzle hinge pins 18*a*, 18*b*.

Mounting arms fixedly attach the mounting frame 12 to the jet motor. An elongate left mounting arm 48 and an elongate right mounting arm 50 extend parallel with one another horizontally away from the mounting frame front side 26. The left mounting arm extends from the mounting frame left wall 38. The right mounting arm extends from the mounting frame right wall 40. The left and right mounting arms are spaced apart to also closely receive the reverse gate 16 between the two mounting arms.

A left gate hinge pin through-hole 52 extends horizontally through the thickness of a free-end portion of the left mounting arm. A right gate hinge pin 54 extends horizontally through the thickness of a free-end portion of the right mounting arm. The left and right gate hinge pin through-holes are coaxial with one another along the reverse gate pivot axis 24 and respectively receive the gate hinge pins 22*a*, 22*b*.

A top mounting arm 56 extends horizontally away from the mounting frame front side 26. The top mounting arm extends from the mounting frame top wall 34. A top mounting through-hole 58 extends vertically through the thickness of a free-end portion of the top mounting hole.

In the illustrated embodiment, the top frame through-hole 58, the left gate hinge pin through-hole 52, and the right gate hinge pin through-hole 54 receive fasteners that fixedly attach the top mounting arm and the left and right mounting arms to the jet motor 914 and thereby rigidly connect the mounting frame 12 to the jet motor. The geometry of the illustrated jet motor 914 is such that the top mounting arm is not required to extend as far from the front of the mounting frame as do the left and right frame mounting arms for attaching the mounting frame to the jet motor.

FIGS. 9-14 illustrate the steering nozzle 14. The steering nozzle is formed as a tubular member extending axially from a front intake end 60 that receives water into the steering nozzle to a rear discharge end 62 that discharges water from the steering nozzle. The steering nozzle has a top wall 64, a bottom wall 66, a right wall 68, and a left wall 70 that define a nozzle flow path 71. The nozzle flow path extends continuously from the intake end to the discharge end of the steering nozzle. The illustrated steering nozzle is a converging nozzle having a rectangular-shaped cross-sectional flow area that reduces in area from the intake end to the discharge end.

Extending vertically through the thickness of the nozzle top wall 64 is a top steering nozzle hinge pin through-hole 72. The top steering nozzle hinge pin is spaced a short distance from the intake end 60 of the steering nozzle 14. A corresponding bottom steering nozzle hinge pin through-hole 74 extends vertically through the thickness of the nozzle bottom wall 66. The top and bottom steering nozzle hinge pin through-holes are coaxial with one another and respectively receive the steering nozzle hinge pins 18*a*, 18*b* that attach the steering nozzle directly to the mounting frame 12.

A steering nozzle control arm 76 is fixed to and extends from the right side of the steering nozzle 30. The control arm is fastened to the steering nozzle right wall 68 adjacent to the nozzle top wall 64. The control arm extends towards the nozzle intake end 60. Extending vertically through the thickness of a free end portion of the control arm is a steering nozzle actuator attachment through-hole 78.

FIGS. 15-20 illustrate the reverse gate 16. The illustrated reverse gate was provided with the jet outboard motor as the reverse gate 926 shown in FIGS. 25 and 26 and is being used as part of the nozzle steering assembly 10.

The reverse gate 16 includes a curved deflector plate 80, a left side wall 82 attached to one side of the deflector plate and a right side wall 84 attached to the other side of the deflector plate. The left and right side walls extend parallel with one another to respective free end portions 86, 88. Extending horizontally through the left free end portion is a left side mounting through-hole 90. Extending horizontally through the right free wall end portion is a right side mounting through-hole 92. The left and right reverse gate mounting through-holes are coaxial with one another and are sized to receive the left gate hinge pin 22*a* and right gate hinge pin 22*b* respectively.

A reverse gate control arm 94 is attached to and extends away from the reverse gate's left side wall free end portion 86. Extending horizontally through the thickness of a free end portion of the control arm 94 is a reverse gate actuator attachment through-hole 96.

FIGS. 21 and 22 illustrate the nozzle steering assembly 10 attached to the jet outboard motor 912 for left-and-right steering of the jet motor boat 910.

Figure 30:
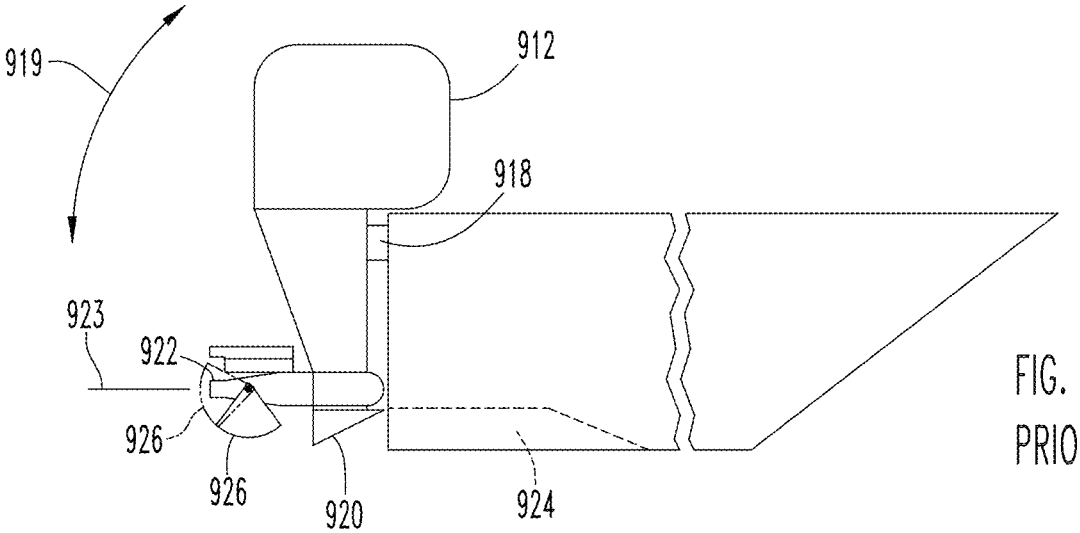
FIG. 30 PRIOR ART
Figure 31:
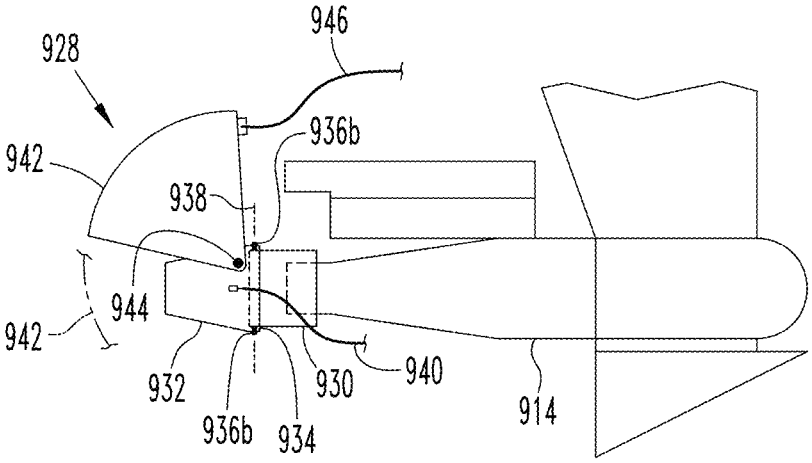
FIG. 31 PRIOR ART
FIG. 31 is a side view of a prior art nozzle steering assembly attached to a jet outboard motor.

The nozzle steering assembly 10 is attached to the jet outboard motor 912 by attaching the left mounting arm 48, the right mounting arm 50, and the top mounting arm 56 to the jet motor 914. The left gate hinge pin 22*a* extends through the left mounting arm gate hinge pin through-hole 52 and the reverse gate left side mounting through-hole 90. The right gate hinge pin 22*b* extends through the right mounting arm right gate hinge pin through-hole 54 and the reverse gate left side mounting through-hole 92. The gate hinge pins are received in blind holes in the jet motor discharge nozzle 922 that originally received the hinge pins that pivotally mounted the reverse gate 926 (as shown in FIG. 30) and attach the left and right mounting arms to the discharge nozzle. A top mounting arm fastener 98 extends through the top mounting through-hole 58 and into a blind fastener hole formed in the jet outboard motor 912.

The gate hinge pins 22*a*, 22*b* pivotally attach the reverse gate 16 to the jet motor 920. The gate hinge pins 22*a*, 22*b*, and the top mounting arm fastener 98 fixedly attach the mounting arms 48, 50, 56 and the mounting frame 12 to the jet motor 920. The mounting frame opening 42 is aligned with the jet motor discharge nozzle 922 such that the nozzle discharge axis 923 passes into the mounting frame opening and into the front intake end 60 of the steering nozzle 14. Spacers 100 located along the steering nozzle hinge pins 18*a*, 18*b* vertically align the steering nozzle with the mounting frame opening and the nozzle discharge axis as desired if the steering nozzle does not extend vertically essentially the full distance between the top and bottom frame walls.

A steering nozzle actuator 102 is directly or indirectly attached to the steering nozzle actuator attachment throughhole 78 and extends from the steering nozzle control arm 76 into the boat 910 to enable selective pivotal movement of the steering nozzle for left-right steering.

A reverse gate actuator 104 is directly or indirectly attached to the reverse gate actuator attachment throughhole 96 and extends from the reverse gate control arm 94 into the boat 910 to enable selective positioning of the reverse gate in its neutral and actuated positions.

The water jet discharged from the jet motor discharge nozzle 922 when not obstructed by the reverse gate 16 flows through the mounting frame opening 42 and into the discharge end of the steering nozzle 14 for all angular positions of the steering nozzle relative to the mounting frame.

The mounting arms 48, 50, 56 space the mounting frame 12 away from the discharge end of the jet motor discharge nozzle 922 so as to define an air gap 106. The air gap extends longitudinally along the jet motor discharge axis 923 between the mounting frame and the jet motor discharge nozzle. The term "air gap" means there is a gap between the mounting frame and the jet motor discharge nozzle open to the external environment.

The reverse gate 16 when in its actuated position (shown in phantom lines in FIG. 22) is disposed in the air gap 106 and is located between the jet motor discharge nozzle 922 and the mounting frame 12. Movement of the reverse gate into and out of the air gap is not obstructed by the mounting arms 48, 50, 56, nor by the mounting frame side walls 30, 32, and nor by the mounting frame bottom and top walls 36, 34. In the illustrated embodiment no mounting arm extends from the mounting frame bottom wall 66 to the jet motor 914 that would otherwise obstruct or impede movement of the reverse gate between its neutral and actuated positions.

The water jet discharged from the jet motor discharge nozzle 922 initially move along the nozzle discharge axis 923. The water jet flows by its own momentum along the nozzle discharge axis 923 through the air gap 106 between the discharge nozzle and the mounting frame 12. The water jet then flows into the mounting frame opening 42 and then into the steering nozzle 14. The air gap permits the reverse gate 16 to move into the air gap and be positioned in its active, actuated position between the mounting frame and the jet motor. The reverse gate in its actuated position intercepts and redirects the water jet for reverse thrust before the water jet reaches the steering nozzle. The orientation of the reverse thrust vector with respect to the boat center line remains essentially constant and is essentially not affected by the angular position of the steering nozzle with respect to the mounting frame.

If a nozzle steering system in accordance with this disclosure utilized a conduit that extended from the jet motor discharge nozzle to the steering nozzle and surrounded the water jet discharged by the discharge nozzle, the conduit would obstruct and prevent movement of the reverse gate from its neutral position to its actuated position. Further, the mounting frame 12 and the mounting arms 48, 50, 56 weigh substantially less than an enclosing conduit and enable easier attachment and removal of the nozzle steering assembly 10 to and from the jet motor 914.

Because displacement of the steering nozzle 14 enables left and right steering, the jet outboard motor 912 is fixed and held stationary with respect to the boat 910 about the outboard motor steering pivot axis. In the illustrated embodiment the boat 918 has a tunnel 924 that enables the nozzle steering assembly 10 and the jet motor 914 to be located above the bottom of the boat. The width of the tunnel 924, however, accommodates left and right turning of the jet motor water intake 920 caused by movement of the jet outboard motor for left and right steering. With the jet outboard motor now fixed with respect to left and right steering, the jet motor water intake also remains fixed with respect to the tunnel. As a result, the tunnel is wider than required to feed a stationary jet motor water intake.

Figure 23:
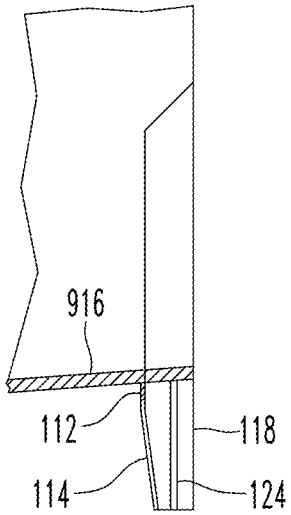
FIG. 23 is a vertical cross-sectional view taken along lines 23-23 of FIG. 24 of a boat hull tunnel and tunnel extension of the jet boat shown in FIG. 22.
Figure 24:
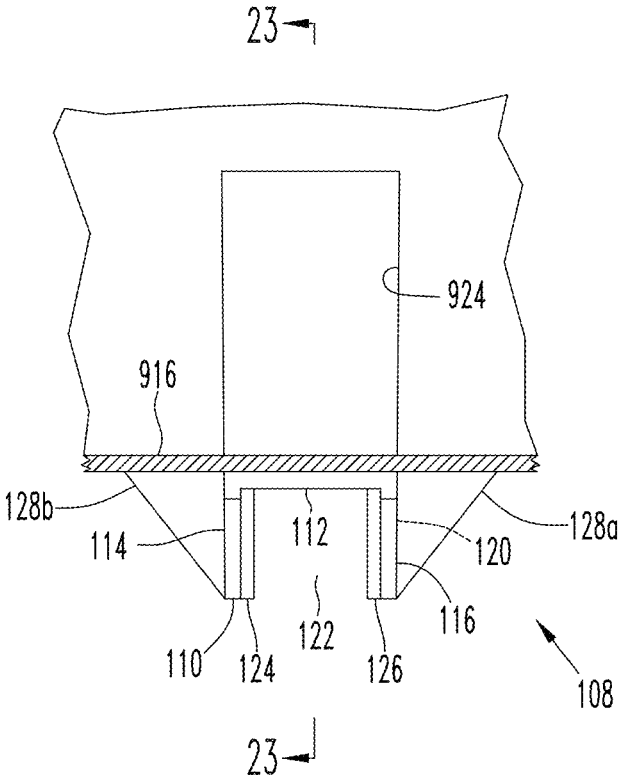
FIG. 24 is a top view of the boat hull tunnel and tunnel extension shown in FIG. 23.

FIGS. 23 and 24 illustrate an external tunnel extension 108 attached to the boat transom. The external tunnel extension is aligned with the boat hull tunnel 924. The external tunnel extension functions to assist in improving water flow from the relatively wide boat hull tunnel 924 to the jet motor water intake 920.

The external tunnel extension 108 is formed as a shroud 110 attached to the transom 916. The shroud includes a relatively narrow upper wall 112 that extends along the upper portion of the boat hull tunnel 924 and then slopes down to form left and right top wall portions 114, 116. A shroud left side wall 118 and a shroud right side wall 120 each extend downwardly from the left and right top wall portions respectively. The shroud left and right side walls are aligned with and extend parallel with the left and right side walls of the boat hull tunnel 924.

The shroud top wall 112 and side walls 114, 116 define a shroud opening 122. The shroud opening extends to and opens to the aft end of the shroud 110 and is longitudinally aligned with the boat hull tunnel 924. Like, generally horizontal left reinforcement plate 124 and right horizontal reinforcement plate 126 are attached to the shroud side walls 118, 120 and extend inwardly into the shroud. The horizontal reinforcement plates are configured to closely receive between them the jet motor water intake 920 when the jet motor water intake is in its lowest vertical position as shown in FIG. 30. The jet motor water intake 920 is within the shroud opening 112 and is closest to the boat transom 916. The shroud does not obstruct or hinder trim adjustment of the jet outboard motor 912 and does not establish or any operating trim position of the jet outboard motor. The shroud does not does not obstruct or hinder conjoint movement of the jet motor water intake with changes in trim position of the jet outboard motor.

The shroud top wall 112 extending along the top of the tunnel 924 is disposed between the jet outboard motor 912 and the transom 916 and does not prevent or obstruct the trim drive 918 from moving the jet outboard motor through the full range of trim motion.

The shroud 110 is reinforced by a pair of triangular, planar reinforcement members 128*a*, 128*b* attached to the transom 916. The reinforcement members are disposed on opposite sides of the shroud adjacent the bottom of the boat. The reinforcement members also reduce spray generated from motion of the boat through the water.

In other tunnel embodiments, the configuration of the boat hull tunnel 924 is designed for a jet outboard motor that utilizes for steering the nozzle steering assembly in accordance with this disclosure.

Figure 26:
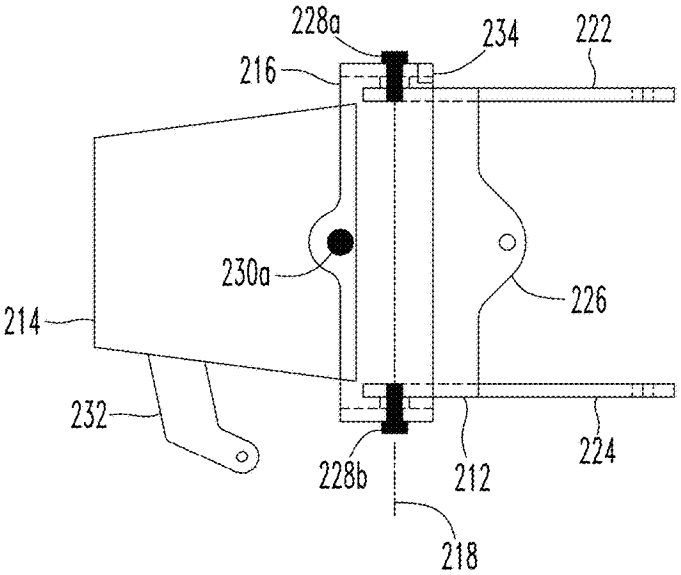
FIGS. 25-27 are side, top, and rear views of a second embodiment nozzle steering assembly in accordance with this disclosure.
Figure 25:
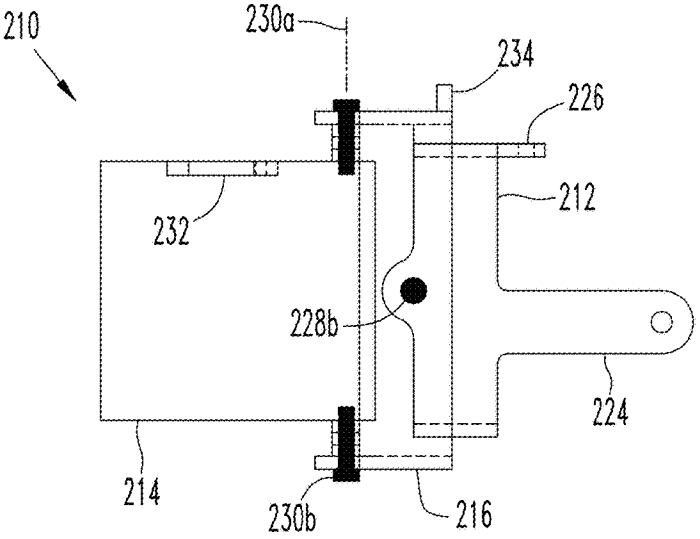
Figure 27:
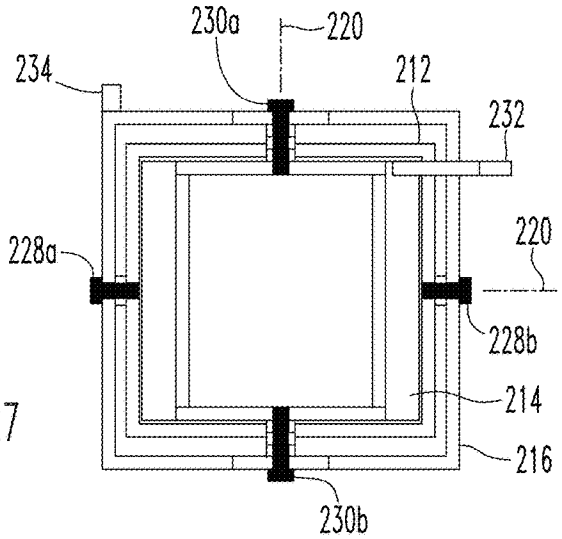

FIGS. 25-27 illustrate a second embodiment nozzle steering assembly 210 in accordance with this disclosure. Only the differences between the first embodiment steering system 10 and the second embodiment nozzle steering assembly 210 will be discussed. The nozzle steering assembly 210 is especially suitable for use with jet outboard motors that do not have power trim to enable the steering nozzle to move for both left-right steering and up-down trim adjustment.

The second embodiment nozzle system 210 includes a mounting frame 212 similar to the mounting frame 12, a steering nozzle 214 similar to the steering nozzle 12, a generally rectangular tilt frame 216, and a reverse gate (not shown in FIGS. 25-27 to simplify the drawings). The tilt frame is attached to the mounting frame 212 for movement about a horizontal tilt frame pivot axis 218 that is fixed relative to the mounting frame. The steering nozzle is attached to the tilt frame for movement about a vertical steering nozzle pivot axis 220 relative to the tilt frame.

The reverse gate is identical to the reverse gate 16. A left mounting arm 222 identical to the left mounting arm 48 and a right mounting arm 224 identical to the right mounting arm 50 extend from the front side of the mounting frame 212 and attach the reverse gate to the mounting frame 212 as previously described for the first embodiment nozzle steering assembly.

A top mounting arm 226 identical to the top mounting arm 58 extends from the top side of the mounting frame 212. The mounting arms 222, 224, 226 space the mounting frame 212 away from the discharge end of the jet motor discharge nozzle 922 when the steering nozzle system 210 is attached to the jet motor 920. The mounting arms define the same air gap 106 (see FIG. 22) between the mounting frame 212 and the jet motor discharge nozzle 922.

The mounting frame 212 does not include structure on the top and bottom walls to receive vertical hinge pins as does the frame 12. Instead the mounting frame 212 and the tilt frame 216 have aligned holes in their left and right side walls that receive tilt frame hinge pins 228*a*, 228*b* that extend along the tilt frame pivot axis 220. The tilt frame hinge pins pivotally attach the tilt frame to the mounting frame.

The steering nozzle 214 and the tilt frame 216 have aligned holes in their top and bottom walls that receive steering nozzle hinge pins 230*a*, 230*b* that extend along the steering nozzle pivot axis 220.

A steering nozzle control arm 232 is fixed to and extends away from the steering nozzle 214. A tilt frame control arm 234 is fixed to and extends away from the tilt frame 216. Each control arm 232, 234 is attached to a respective actuator (not shown) to enable moving the steering nozzle about the steering nozzle pivot axis 220 for left-right steering and to move the tilt frame 216 about the tilt frame pivot axis 218 for trim adjustment.

In alternative embodiments of the second embodiment nozzle steering assembly 210, the tilt frame 216 is mounted instead to the mounting frame 212 for relative pivotal movement about a vertical axis. The steering nozzle 214 is mounted to the tilt frame for relative pivotal movement about a horizontal axis. Movement of the tilt frame generates left-right steering and movement of the steering nozzle generates trim adjustment.

Figure 28:
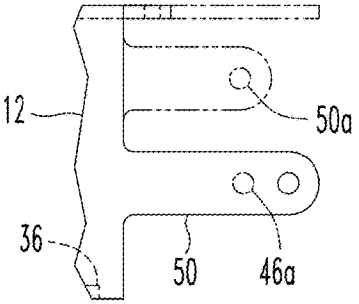
FIG. 28 is a partial side view of a modified mounting frame in accordance with this disclosure.
Figure 29:
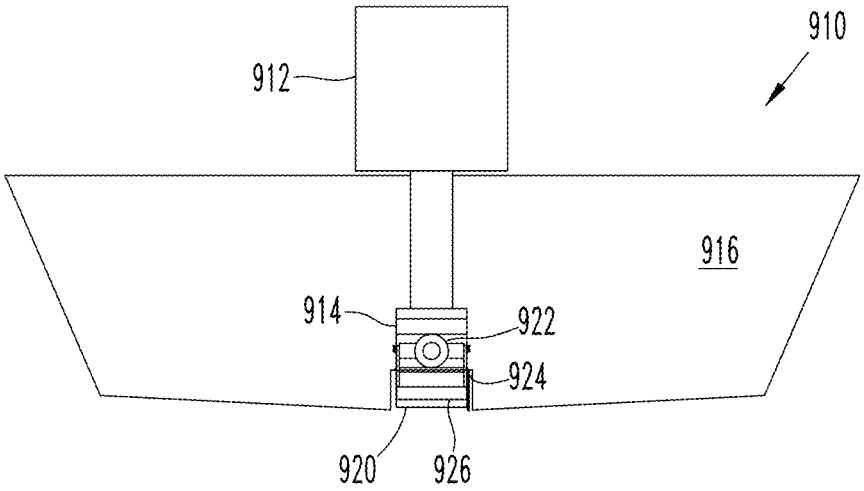
FIG. 29 PRIOR ART
FIGS. 29 and 30 are rear and side views of a prior art jet boat with a jet outboard motor.

FIG. 28 illustrates a portion of a modified mounting frame 12 and modified embodiments of mounting arms shown in phantom lines extending from the front side of the mounting frame. The mounting frame bottom wall 36 has a front wall side that is recessed inwardly from the front wall sides of the mounting frame top and side walls. The resulting narrower bottom wall provides additional clearance for the reverse gate to move between the mounting frame and the discharge nozzle of the water jet motor.

The right mounting arm 50 has an additional through hole 46*a* in addition to the through-hole 46, and the left mounting arm 48 has a corresponding additional hole. In this embodiment the original mounting arm holes are used in attaching the mounting frame to the jet motor and the additional holes pivotally attach the reverse gate. The hole functions can be reversed in other possible embodiments.

Also shown is an additional right mounting arm 50*a* that is used in attaching the mounting frame to the jet motor. That is, the number and relative positioning of mounting arms with respect to the mounting frame can vary depending on the geometry and mounting locations provided for by the jet motor 914 or jet outboard motor 912.

One, some, or all of the mounting arms can also twist or bend as an arm extends away from the mounting frame to conform to the attachment point of the mounting arm on the jet motor or on the jet outboard motor.

Alternatively, a mounting arm can have multiple fastener holes that attach the arm to the jet motor. If the mounting arm is strong enough and durable enough for its environment of use, the mounting arm can be the sole mounting arm of a nozzle steering assembly in accordance with this disclosure.

A mounting frame and tilt frame in accordance with this disclosure preferably surrounds an opening that receives the water jet discharged from the jet motor for mechanical strength. The mounting frame or tilt frame may be circular, partly circular, polygonal, or the like in shape to define the opening surrounded by the mounting frame or tilt frame. Other mounting frame and tilt frame constructions may be used that can function satisfactorily as a mounting frame and tilt frame in their environment of use, including mounting frames and tilt frames that do not completely surround the flow of water issued from the water jet discharge nozzle.

The intake end of a steering nozzle may be disposed in an opening defined by the mounting frame or the tilt frame. Alternatively the mounting frame or tilt frame may be disposed in the intake end of the steering nozzle. (see Fig. may s be circular or multi-sided in shape to define the opening surrounded by the mounting frame or tilt frame. The mo Each of the first and second embodiment steering nozzle assemblies 10, 210 are configured to have clockwise pivotal rotation of the reverse gate 16 as viewed in FIG. 22 from the lowered neutral position shown in FIG. 22 to the actuated position. The reverse gate passes adjacent to the mounting frame bottom wall.

In further possible embodiments of the steering nozzle assembly in accordance with this disclosure, a reverse gate 16' (partially shown in phantom lines in FIG. 22) is disposed on the opposite side of the nozzle discharge axis when in a raised, neutral position. The reverse gate 16' has clockwise pivotal rotation as viewed in FIG. 22 when moving from the neutral position to the actuated position. The mounting arms used with the reverse gate 16' would extend from the mounting frame in a configuration that enables the reverse gate to enter the air gap 106 by passing adjacent to the mounting frame top wall.

An advantage of some embodiments of the disclosed nozzle steering assemblies is the nozzle steering assembly can be attached to an existing outboard jet motor having an already mounted, existing reverse gate with little or no modification of the reverse gate or the actuator used with the reverse gate. It may not be necessary to replace or modify an existing reverse gate or reverse gate actuator.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) adapting the disclosed power steering system to: boats having different lengths, widths, hull shapes, tunnel shapes and number of tunnels, actuator and actuator attachment configurations and the like, having one outboard motor or multiple outboard motors, fresh water use or salt water use, jet outboard motors having different sizes, power output, and water intake requirements, outlet housing configurations, use with a transom riser, and other design choices made in the design of a jet motor boat.

What is claimed is:

1. A nozzle steering assembly for a jet outboard motor comprising:

a mounting frame and at least one mounting arm connected to the mounting frame, the at least one mounting arm being adapted to fixedly attach the mounting frame to a jet motor of the jet outboard motor;

wherein the at least one mounting arm spaces the mounting frame away from a discharge end of a jet motor discharge nozzle and defines an air gap between the mounting frame and the jet motor discharge nozzle when the mounting frame is attached to the jet motor by the at least one mounting arm;

a steering nozzle being connected to the mounting frame and being pivotable with respect to the mounting frame about a steering nozzle pivot axis, the steering nozzle being disposed to receive a flow of water discharged from the jet motor discharge nozzle into an intake end of the steering nozzle and to discharge the flow of water through a discharge end of the steering nozzle when the mounting frame is attached to jet motor whereby displacement of the steering nozzle about the nozzle pivot axis with respect to the mounting frame causes a change in the flow direction of water discharged from the steering nozzle; and a reverse gate being connected to the mounting frame, the reverse gate being movable with respect to the mounting frame independently of the steering nozzle about a reverse gate pivot axis between a neutral position and an actuated position;

wherein when the reverse gate is in the neutral position, the reverse gate is disposed to not obstruct the flow of water discharged from the jet motor discharge nozzle when the mounting frame is attached to the jet motor; and wherein when the reverse gate is in the actuated position, the reverse gate is disposed between the mounting frame and the jet motor discharge nozzle in the air gap and is configured to intercept and substantially reverse the flow direction of the flow of water discharged from the jet motor discharge nozzle when the mounting frame is attached to the jet motor.

2. The nozzle steering assembly of claim 1 wherein the mounting frame has a front side that faces the jet motor when the mounting frame is attached to the jet motor, the mounting frame being configured to enable the flow of water discharged from the jet motor to flow past the front side of the mounting frame before entering the intake end of the steering nozzle.

3. The nozzle steering assembly of claim 2 wherein the mounting frame defines an opening extending from the front side of the mounting frame in fluid communication with the intake end of the steering nozzle, the mounting frame being configured to enable the flow of water discharged from the jet motor to flow into the opening from the front side of the mounting frame and into the intake end of the steering nozzle.

4. The nozzle steering assembly of claim 3 wherein the opening of the mounting frame extends from the front side of the mounting frame to an opposite rear side of the mounting frame.

5. The nozzle steering assembly of claim 4 wherein the intake end of the steering nozzle is disposed in the mounting frame opening.

6. The nozzle steering assembly of claim 1 wherein the at least one mounting arm comprises a first mounting arm and a second mounting arm, wherein when the mounting frame is attached to the jet motor the reverse gate is pivotally attached to the first and second mounting arms with the first and second mounting arms being spaced apart from one another along the reverse gate pivot axis.

7. The nozzle steering assembly of claim 1 wherein the reverse gate is not in fluid communication with the steering nozzle.

8. The nozzle steering assembly of claim 1 wherein the steering nozzle pivot axis is defined by a first pair of hinge pins held by the mounting frame, the steering nozzle only movable with respect to the mounting frame about the nozzle pivot axis.

9. The nozzle steering assembly of claim 8 wherein the steering nozzle pivot axis extends vertically with respect to the mounting frame when the mounting frame is attached to the jet motor for left-right steering of a watercraft driven by the outboard motor by displacement of the steering nozzle relative to the mounting frame about the steering nozzle pivot axis.

10. The nozzle steering assembly of claim 8 wherein the steering nozzle pivot axis extends horizontally with respect to the mounting frame when the mounting frame is attached to the jet motor for trim adjustment of a watercraft driven by the outboard motor by movement of the steering nozzle relative to the mounting frame about the steering nozzle pivot axis.

11. The nozzle steering assembly of claim 1 comprising a tilt frame being pivotally attached to the mounting frame and movable with respect to the mounting frame about a tilt frame pivot axis; and the steering nozzle being pivotally attached to the tilt frame wherein the tilt frame connects the steering nozzle with the mounting frame, the steering nozzle being movable with respect to the tilt frame about the nozzle pivot axis.

12. The nozzle steering assembly of claim 11 wherein the steering nozzle pivot axis extends vertically with respect to the tilt frame when the mounting frame is attached to the jet motor for left-right steering of a watercraft driven by the outboard motor by movement of the steering nozzle about the nozzle pivot axis relative to the tilt frame;

the tilt frame pivot axis extends horizontally with respect to the mounting frame when the mounting frame is attached to the jet motor for trim adjustment of a watercraft driven by the outboard motor by movement of the tilt frame about the tilt frame pivot axis relative to the mounting frame.

13. The nozzle steering assembly of claim 11 wherein the steering nozzle pivot axis extends horizontally with respect to the tilt frame when the frame is attached to the jet motor for trim adjustment of a watercraft driven by the outboard motor by movement of the steering nozzle about the steering nozzle pivot axis relative to the tilt frame; and the tilt frame pivot axis extends vertically with respect to the mounting frame when the mounting frame is attached to the jet motor for left-right steering of a watercraft driven by the outboard motor by movement of the tilt frame about the tilt frame pivot axis relative to the mounting frame.

14. The steering nozzle assembly of claim 11 wherein the mounting frame has a front side that is configured to face the jet motor when the steering nozzle assembly is attached to the jet motor;

the tilt frame has a front side that is configured to face the jet motor when the steering nozzle assembly is attached to the jet motor;

the mounting frame being configured to enable the flow of water discharged from the jet motor to flow past the front side of the mounting frame before reaching the front side of the tilt frame; and the tilt frame being configured to enable the flow of water discharged from the jet motor to flow past the front side of the tilt frame before reaching the intake end of the steering nozzle.

15. The steering nozzle assembly of claim 14 wherein the mounting frame defines a through-opening surrounded by the mounting frame;

the tilt frame defines a through-opening surrounded by the tilt frame; and the mounting frame and the tilt frame each being configured so that when the steering nozzle assembly is attached to the jet motor the mounting frame and the tilt frame are each disposed to enable the flow of water discharged from the jet motor to enter the mounting frame through-opening and then enter the tilt frame through opening before entering the steering nozzle intake end.

16. The steering nozzle assembly of claim 15 wherein the intake end of the steering nozzle is disposed in the tilt frame through-opening.

17. The nozzle steering assembly of claim 1 wherein the steering nozzle pivot axis is defined by a first pair of hinge pins held by the tilt frame, the steering nozzle only movable with respect to the tilt frame about the steering nozzle pivot axis; and the tilt frame pivot axis is defined by a second pair of hinge pins held by the mounting frame, the tilt frame only movable with respect to the mounting frame about the tilt frame pivot axis.

18. The steering nozzle assembly of claim 1 wherein the at least one mounting arm comprises a first mounting arm and a second mounting arm;

the reverse gate is pivotally mounted to the first mounting arm by a first hinge pin and is pivotally mounted to the second mounting arm by a second hinge pin, the first and second hinge pins defining the reverse gate pivot axis; and the first mounting arm is attached to the jet motor by the first hinge pin and the second mounting arm is attached to the jet motor by the second hinge pin.

19. A watercraft comprising:

a jet outboard motor attached to a hull of the watercraft, the jet outboard motor comprising a jet motor and a discharge nozzle being configured to discharge a water jet that provides thrust for driving the watercraft;

a nozzle steering assembly attached to the jet motor, the nozzle steering assembly comprising:

(a) a mounting frame and at least one mounting arm connected to the mounting frame, the at least one mounting arm fixedly attaching the mounting frame to the jet motor;

(b) the at least one mounting arm spacing the mounting frame away from a discharge end of the jet motor discharge nozzle and defining an air gap between the mounting frame and the jet motor discharge nozzle;

(c) a steering nozzle being connected to the mounting frame and pivotable with respect to the mounting frame about a steering nozzle pivot axis, the steering nozzle being disposed to receive the water jet discharged from the jet motor discharge nozzle into an intake end of the steering nozzle and discharging the flow of water through a discharge end of the steering nozzle whereby movement of the steering nozzle about the steering nozzle pivot axis causes a change in the flow direction of water discharged from the steering nozzle; and (d) a reverse gate being connected to the mounting frame, the reverse gate being movable with respect to the mounting frame independently of the steering nozzle about a reverse gate pivot axis between a neutral position and an actuated position;

wherein when the reverse gate is in the neutral position, the reverse gate is disposed to not obstruct the flow of water discharged from the jet motor discharge nozzle; and wherein when the reverse gate is in the actuated position, the reverse gate is disposed in the air gap between the mounting frame and the jet motor discharge nozzle and is configured to intercept and substantially reverse the flow direction of the water jet discharged from the jet motor discharge nozzle.

20. The watercraft of claim 19 wherein the steering nozzle assembly comprises a tilt frame pivotally attached to the mounting frame for pivotal movement with respect to the mounting frame about a tilt frame pivot axis;

the steering nozzle is pivotally attached to the tilt frame for pivotal movement with respect to the tilt frame about the steering nozzle pivot axis; and one of the tilt frame pivot axis and the steering nozzle pivot axis being a horizontal axis and the other of the tilt frame pivot axis and the steering nozzle axis being a vertical axis of the steering nozzle assembly.

* * * * *